US008998195B2

(12) United States Patent
Hong et al.

(10) Patent No.: US 8,998,195 B2
(45) Date of Patent: Apr. 7, 2015

(54) AUTOMATIC DOCUMENT FEEDER

(71) Applicant: Foxlink Image Technology Co., Ltd., New Taipei (TW)

(72) Inventors: I Chuan Hong, New Taipei (TW); Lung Chen, New Taipei (TW); Tsung Ching Chou, New Taipei (TW); Ting Yu Lu, New Taipei (TW); Jing Hua Fang, New Taipei (TW); Chuan Chun Wang, New Taipei (TW); Wen Ching Liao, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 0 days.

(21) Appl. No.: 13/910,543

(22) Filed: Jun. 5, 2013

(65) Prior Publication Data

US 2014/0361481 A1 Dec. 11, 2014

(51) Int. Cl.

| | |
|---|---|
| ***B65H 29/00*** | (2006.01) |
| ***B65H 5/26*** | (2006.01) |
| ***B65H 5/06*** | (2006.01) |

(52) U.S. Cl.

CPC ... *B65H 5/26* (2013.01); *B65H 5/06* (2013.01)

(58) Field of Classification Search

USPC ..... 271/65, 186, 185, 225

See application file for complete search history.

(56) References Cited

U.S. PATENT DOCUMENTS

2005/0263956 A1* 12/2005 Uchida et al. ..... 271/186
2009/0085280 A1* 4/2009 Litman et al. ..... 271/186

* cited by examiner

*Primary Examiner* — Thomas Morrison

(74) *Attorney, Agent, or Firm* — WPAT, P.C.; Anthony King; Kay Yang

(57) ABSTRACT

An automatic document feeder includes a paper transmitting path for guiding documents, a driving motor for providing driving torque, a pickup device disposed at the upstream of the paper transmitting path, an output device disposed at the downstream of the paper transmitting path and transmitting rollers disposed along the paper transmitting path for transmitting the documents, a first driving gear disposed between the pickup device and the output device, a transmitting gear swing arm equipped with a transmitting gear set and axially hinged with the first driving gear to swing according to the driving torque between a first position meshing the transmitting gear set with the pickup device and a second position idling the transmitting gear set, an actuator connected with the output device and a braking device disposed on the output device for locking the transmitting gear swing arm according to the position of the output device.

6 Claims, 12 Drawing Sheets

AUTOMATIC DOCUMENT FEEDER

BACKGROUND OF THE INVENTION

1. Field of the Invention

The present invention relates to an automatic document feeder, especially to an automatic document feeder with double-side scanning function.

2. The Related Art

In order to increase the efficiency of scanning and to achieve the function of double-side scanning, most scanners are equipped with an automatic document feeder.

Referring to FIG. 1, a sectional view of a conventional automatic document feeder is shown. The automatic document feeder defines a paper transmitting path for transmitting documents, and the paper transmitting path includes an input tray 11', an input path 12', a scanning section 13', an output path 14' and an output tray 15'. A reverse path 16' is connected between the input path 12' and the output path 14'.

In order to transmit documents through respective path above, a plurality of transmitting devices are disposed along corresponding path. For example, a pickup device 20' is disposed at the entrance of the input path 12', scan roller 171', transmitting roller 172' are disposed along the input path 12' and the output path 14', and an output device 30' is disposed at the exit of the output path 14'.

Various transmitting devices act in different ways. In detail, the pickup device 20' will press downward to documents in the input tray 11' to pick one of the documents into the input path 12' when the scanning process starts, and rise up to avoid multi-feed when the picked document enters the input path 12' and reaches the scan roller 171'. The scan rollers 171' and the transmitting roller 172' will keep rotating in a same direction to transmit un-scanned documents for scanning and to discharge scanned documents to the output tray 15' in the whole scanning process. The output device 30' includes an acting roller 31' and a movable pressure roller 32'. The pressure roller 32' keeps contact with the acting roller 31' to transmit documents in single-side scanning process, but in the double-side scanning process, the output device 30' will reverse and transmit the document back to the reverse path 16' when the document passes through the scanning section 13'. Furthermore, when the document passes through the reverse path 16' and is transmitted to the output device 30' again, the pressure roller 32' will swing downward and separate from the acting roller 31' to avoid the document being jammed at the output device 30'.

As described above, the scan rollers 171' and the transmitting roller 172' basically rotate in the same direction, the pickup device 20' and the output device 30' can change the rotate directions according to the position of the document, and the pressure roller 32' of the output device 30' is movable to contact with the acting roller 31' or to separate from the acting roller 31', so as to make the automatic document feeder achieve double-side scanning for the document. However, the conventional automatic document feeder has a complex structure and is difficult to be miniaturized. Therefore, it is necessary to improve the conventional automatic document feeder.

SUMMARY OF THE INVENTION

An objective of this invention is to provide an automatic document feeder which is easy to be miniaturized and to be produced.

To achieve the objective, the automatic document feeder includes a paper transmitting path including an input tray, an input path, a scanning area, an output path and an output tray in sequence from the upstream to the downstream, a driving motor for providing driving torque in different directions, at least one transmitting roller which is disposed among the paper transmitting path, a pickup device which is disposed at the upstream of the paper transmitting path to pick documents up under the control of the driving torque, an output device including movable pressure rollers and acting rollers which are disposed at the downstream of the paper transmitting path to transmit documents forward or backward under the control of the driving torque, a first driving gear driven by the driving motor and disposed between the pickup device and the output device, a transmitting gear swing arm axially hinged with the first driving gear and equipped with a transmitting gear set, an actuator connected between the transmitting gear swing arm and the output device for controlling the movement of the pressure rollers, and a braking device which is disposed on the output device for locking the transmitting gear swing arm according to the position of the output device. The transmitting gear swing arm is swingable according to the driving torque in the different directions between a first position meshing the transmitting gear set with the pickup device and a second position idling the transmitting gear set.

In summary, the automatic document feeder is characterized in that the braking device is disposed on the output device and is driven and controlled by the output device to determine whether and when the driving torque of the driving motor is transmitted to the pickup device, so that effectively reduces the size and the production cost of the automatic document feeder.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
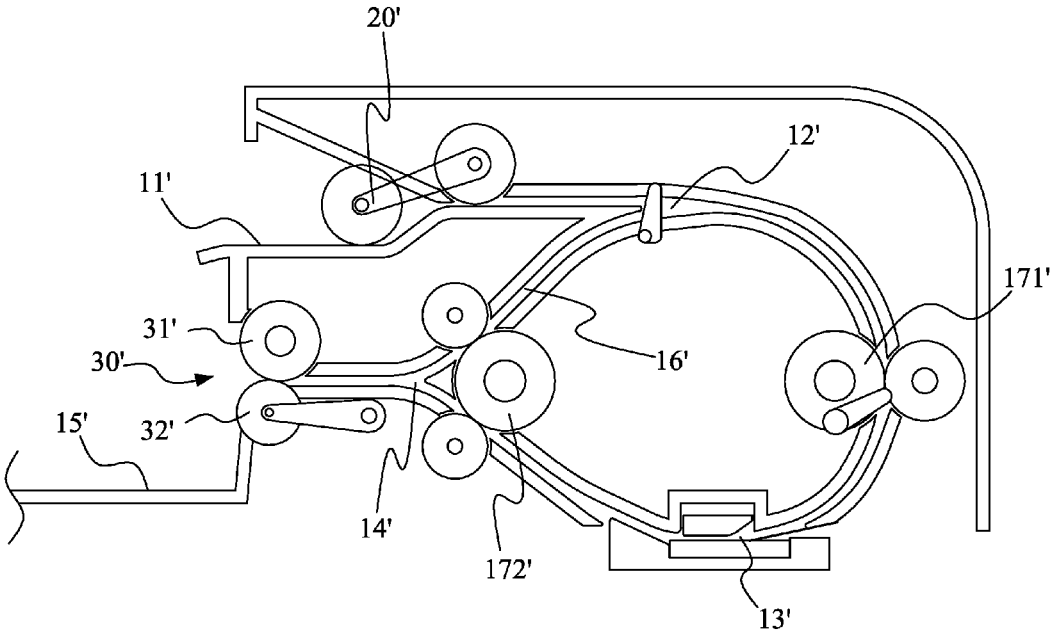
(Prior Art) FIG. 1
FIG. 1 shows a cross-sectional view of a conventional automatic document feeder.

Referring to FIG. 2 to FIG. 4, FIG. 8A and FIG. 8B, an automatic document feeder according to an embodiment of the present invention includes a paper transmitting path 10 for guiding documents, a driving motor 41 for providing driving torque in different directions, a transmitting device which includes a pickup device 20 disposed at the upstream of the paper transmitting path 10, an output device 30 disposed at the downstream of the paper transmitting path 10 a scan roller 171 and a transmitting roller 172 disposed along the paper transmitting path 10 for transmitting the documents, a first driving gear 40 driven by the driving motor 41 and disposed between the pickup device 20 and the output device 30, a transmitting gear swing arm 50 equipped with a transmitting gear set 51 and axially hinged with the first driving gear 40 to swing according to the driving torque in the different directions between a first position meshing the transmitting gear set 51 with the pickup device 20 and a second position idling the transmitting gear set 51, an actuator 70 connected with the output device 30 and a braking device 80 disposed on the output device 30 for locking the transmitting gear swing arm 50 according to the position of the output device 30.

The paper transmitting path 10 includes an input tray 11, an input path 12, a scanning area 13, an output path 14 and an output tray 15 in sequence from the upstream to the downstream, and a reverse path 16 which connects between the input path 12 and the output path 14. The pickup device 20 is arranged to pick up the documents under the control of the driving torque of the driving motor 41. The output device 30 is arranged to transmit the documents forward or backward under the control of the driving torque of the driving motor 41, and includes acting rollers 31 and movable pressure rollers 32 which are able to contact with or separate from the acting rollers 31 under the control of the actuator 70.

A one-way gear set 60 is further disposed between the scan roller 171 and the transmitting roller 172 to apply the driving torque in a constant direction to the transmitting roller 172 regardless of the directions of the driving torque provided by the driving motor 41. The braking device 80 is driven by the output device 30 and disposed between the transmitting gear swing arm 50 and the output device 30 for locking the transmitting gear swing arm 50.

Figure 2:
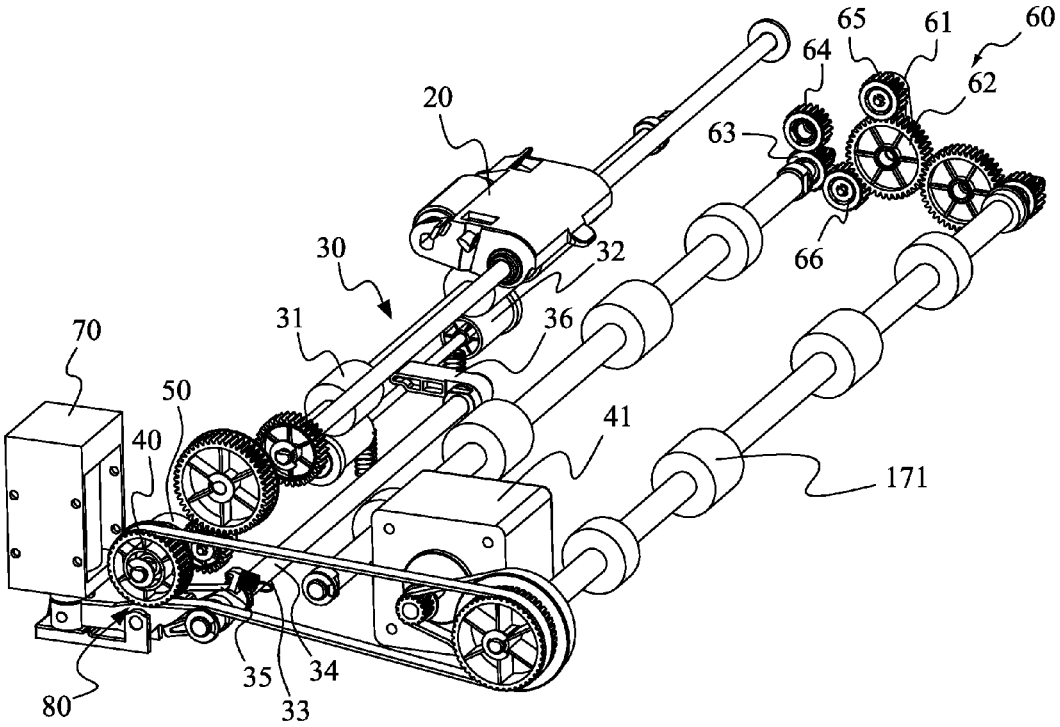
FIG. 2 shows a perspective view of a transmitting device of an automatic document feeder according to an embodiment of the present invention.
Figure 3:
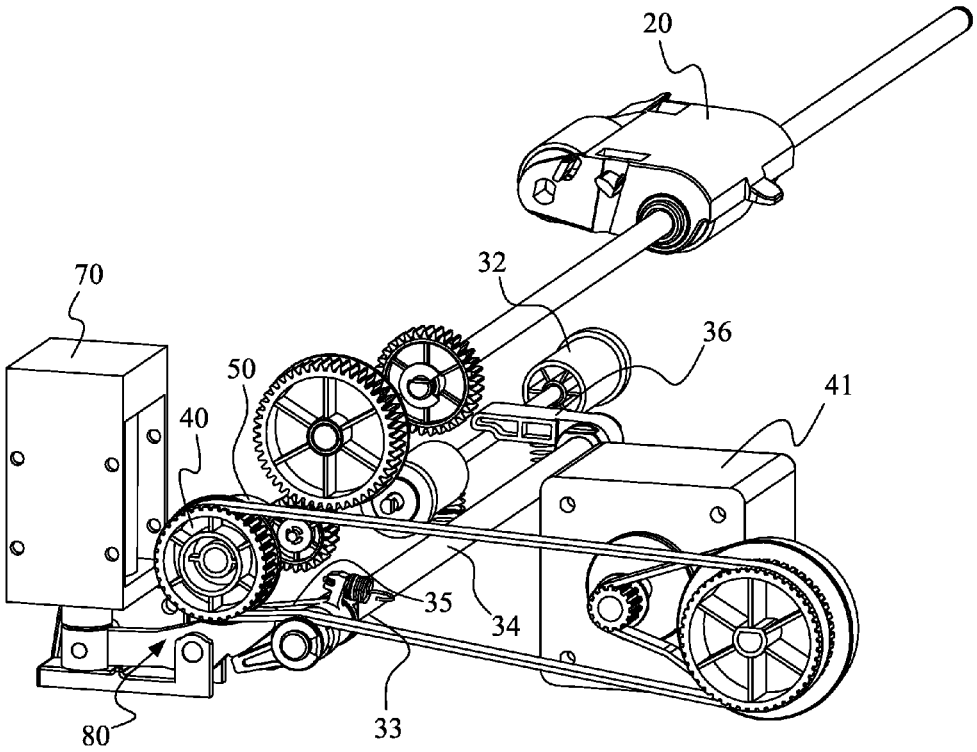
FIG. 3 shows a perspective view of a first driving gear, an actuator and a braking device of the automatic document feeder of FIG. 2.

Referring to FIG. 2, the output device 30 includes a set of acting rollers 31, a set of movable pressure rollers 32 disposed opposite to the acting rollers 31, and a pressure roller swing arm 33 which is disposed between the pressure roller 32 and the actuator 70 for controlling the pressure rollers 32 to contact with or separate from the acting rollers 31. The pressure roller swing arm 33 includes a rotating shaft 34, a first pressing arm 35 and a second pressing arm 36 mounted to the opposite ends of the rotating shaft 34 respectively. The first pressing arm 35 is contacted with the actuator 70, and the second pressing arm 36 is contacted with the pressure rollers 32, so the actuator 70 is capable to control the position of the pressure rollers 32 by means of the rotating shaft 34. The actuator 70 in this embodiment is a solenoid connected with the pressure roller swing arm 33 by means of a control lever. When the solenoid rises, the control lever will be pressed down to separate the pressure roller 32 from the documents, and when the solenoid moves downward, the control lever will rise up to contact the pressure roller 32 with the documents.

Figure 4:
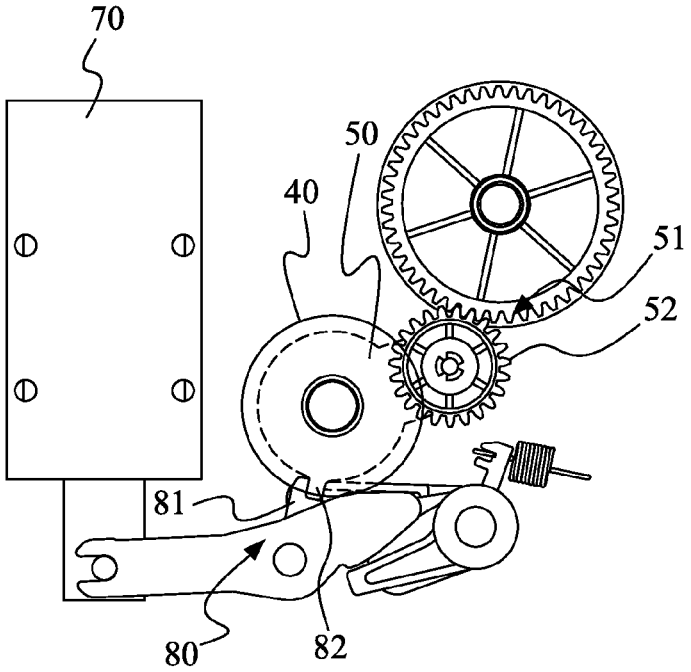
FIG. 4 shows a side view of the first driving gear, the actuator and the braking device of the automatic document feeder of FIG. 3.
Figure 7:
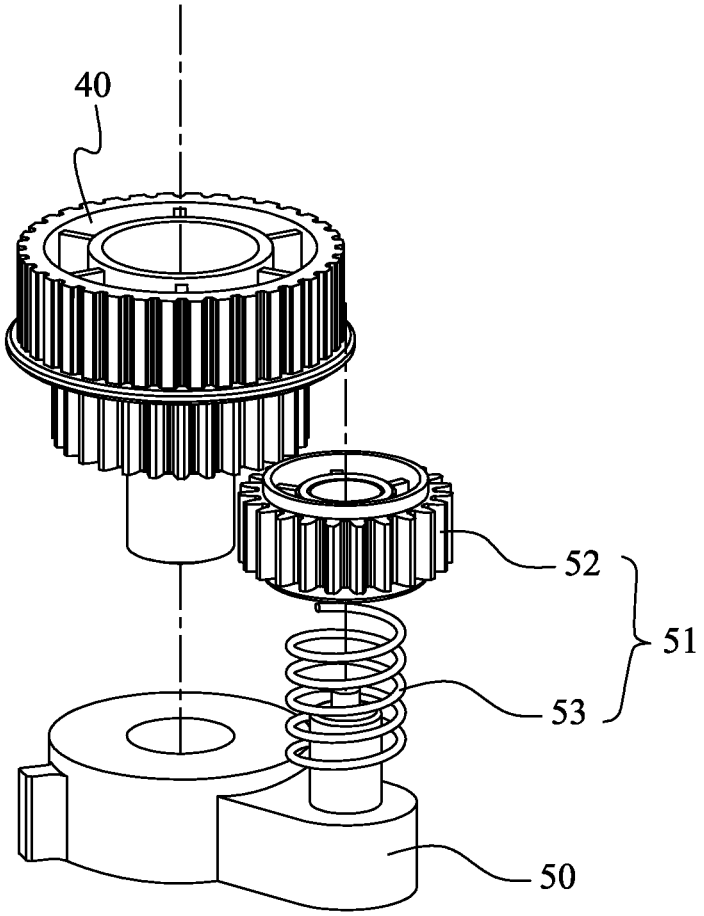
FIG. 7 shows an exploded view of a transmitting gear set of the automatic document feeder of FIG. 2.

Referring to FIG. 4 and FIG. 7, the transmitting gear set 51 includes a first transmitting gear 52 and a first torque limiter 53. The first transmitting gear 52 is meshed with the first driving gear 40 and hinged with the transmitting gear swing arm 50 by means of the first torque limiter 53. The first torque limiter 53 has a maximum torque limit. If the driving torque transmitted between the first transmitting gear 52 and the transmitting gear swing arm 50 is smaller than the torque limit, the first transmitting gear 52 will not rotate relatively to the transmitting gear swing arm 50.

Therefore, when the first driving gear 40 rotates, the transmitting gear swing arm 50 will swing between the first position meshing the first transmitting gear 52 with the pickup device 20 to transmit the driving torque to the pickup device 20, and the second position separating the first transmitting gear 52 from the pickup device 20 and idling the first transmitting gear 52.

The braking device 80 in this embodiment is a pair of first and second latches 81, 82, the first latch 81 is disposed on the pressure roller swing arm 33 and the second latch 82 is disposed on the transmitting gear swing arm 50. When the pressure roller swing arm 33 rises up, the first latch 81 will mesh with the second latch 82 to lock the transmitting gear swing arm 50. In this embodiment, the first latch 81 is a block extended from the upper surface of the first pressing arm 35, and the second latch 82 is a block extended from the lower end of the transmitting gear swing arm 50. But the first and the second latches 81, 82 are not limited to two opposite blocks shown in this embodiment.

Figure 5:
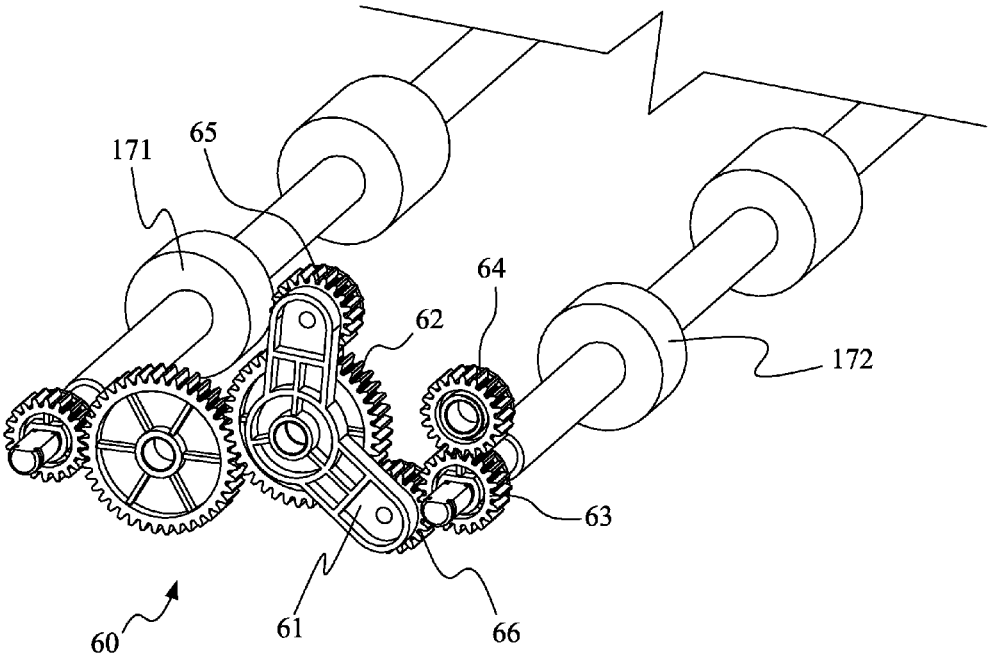
FIG. 5 shows a perspective view of a one-way gear set of the automatic document feeder of FIG. 2.

Referring to FIG. 2, FIG. 5 and FIG. 6, the one-way gear set 60 is connected with the scan roller 171 and the transmitting roller 172 and drived by the driving motor 41. The one-way gear set 60 includes a second driving gear 62, a one-way gear swing arm 61 axially hinged with the second driving gear 62, an output gear 63 meshed with the transmitting roller 172, a reverse gear 64 meshed with the output gear 63, and a second and a third transmitting gears 65, 66 hinged on the one-way gear swing arm 61.

Figure 6A:
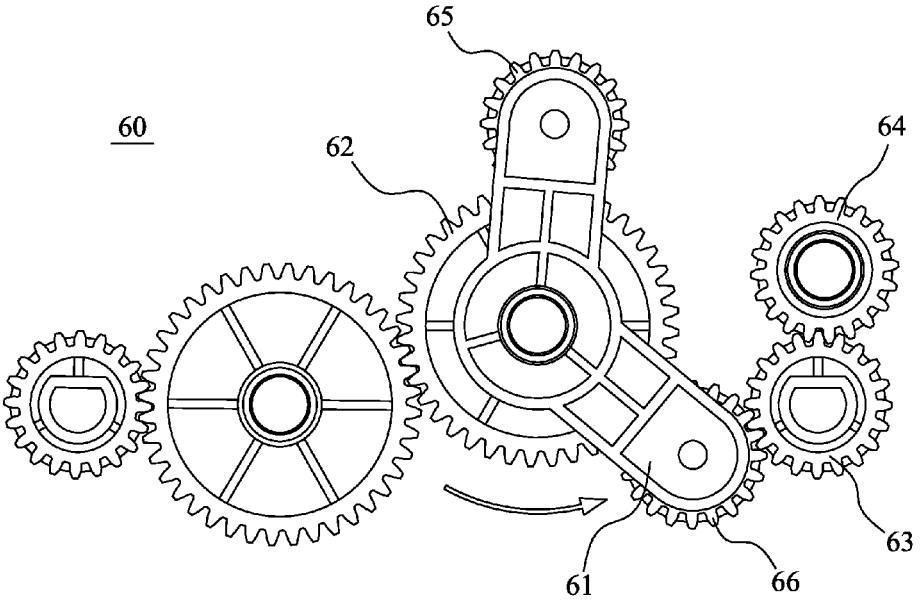
FIG. 6A shows a side view of the one-way gear set being located in a third position.
Figure 6B:
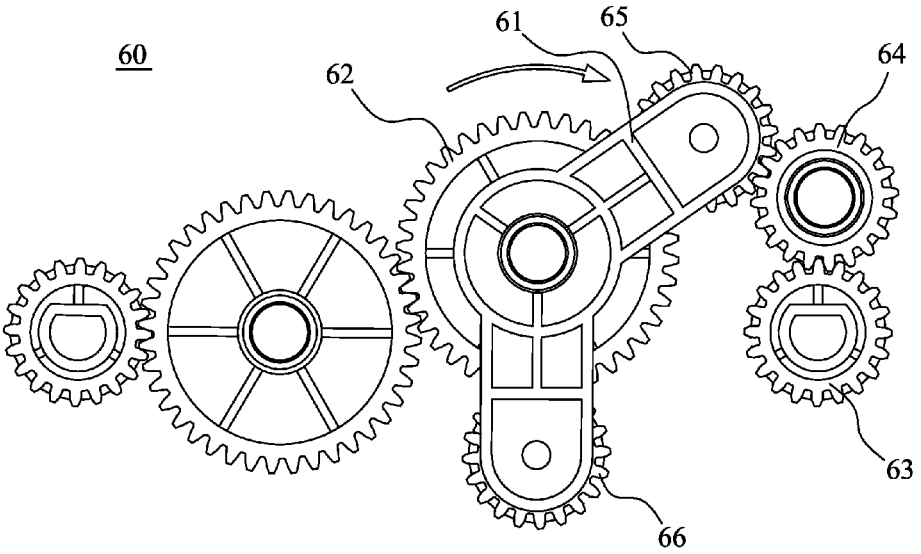
FIG. 6B shows a side view of the one-way gear set being located in a fourth position.

The one-way gear swing arm 61 includes two free ends. The second and the third transmitting gears 65, 66 are hinged on the free ends of the one-way gear swing arm 61 by means of a second and a third torque limiters (not shown) respectively, and both of them mesh with the second driving gear 62. The one-way gear swing arm 61 is capable to swing between a third position meshing the third transmitting gear 66 with the output gear 63 (as shown in FIG. 6A) and a fourth position meshing the second transmitting gear 65 with the reverse gear 64 (as shown in FIG. 6B) according to the rotate direction of the second driving gear 62 to ensure the driving torque transmitted to the transmitting roller 172 is in a constant direction.

Referring to FIG. 7, the torque limiters in this embodiment are compress springs positioned between the swing arms 50, 61 and the transmitting gears 52, 65, 66 to increase the normal force and the friction between the swing arms 50, 61 and the transmitting gears 52, 65, 66.

The automatic document feeder in this invention is capable to transmit documents in different ways according to different scanning processes, and the process for single-side scanning is shown below.

Figure 8A:
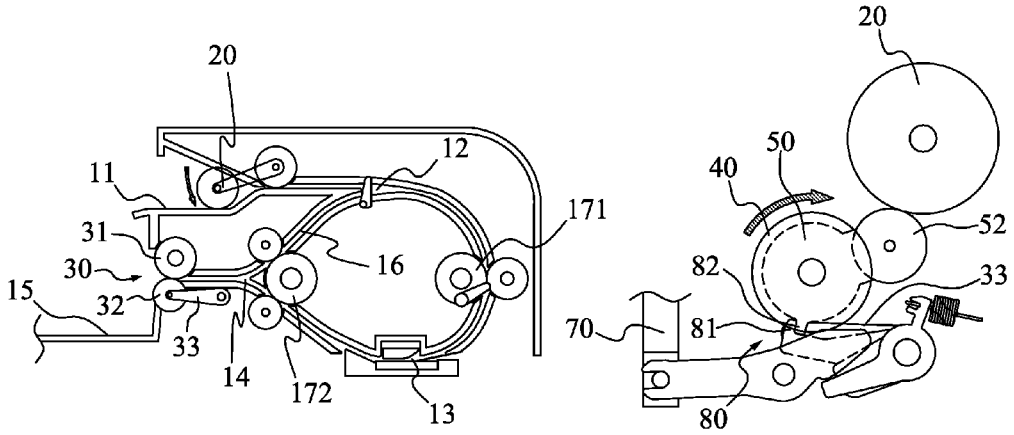
FIG. 8A to FIG. 12B are schematic diagrams showing actions of the automatic document feeder of FIG. 2 transmitting documents.

Referring to FIG. 8A, when the automatic document feeder starts to scan, original documents are placed in the input tray 11. The transmitting gear swing arm 50 is at the first position and locked by the braking device 80. When the driving motor 41 rotates clockwise, the first driving gear 40 transmits the driving torque to the pickup device 20 and drives the pickup device 20 to press down for picking the documents. In this moment, the driving motor 41 rotates clockwise, thus the pickup device 20, the scan roller 171, the transmitting roller 172 and the output device 30 all rotate in the direction transmitting the documents to pass through the input path 12, the scanning area 13, the output path 14 and the output tray 15 in sequence.

The process of double-side scanning is described below.

Referring to FIG. 8A, when the automatic document feeder starts to scan, original documents are placed in the input tray 11, and the transmitting gear swing arm 50 is at the first position and locked by the braking device 80. Then the driving motor 41 rotates clockwise to transmit the driving torque to the pickup device 20 and drive the pickup device 20 to press down to pick one of the documents into the input path 12.

Figure 8B:
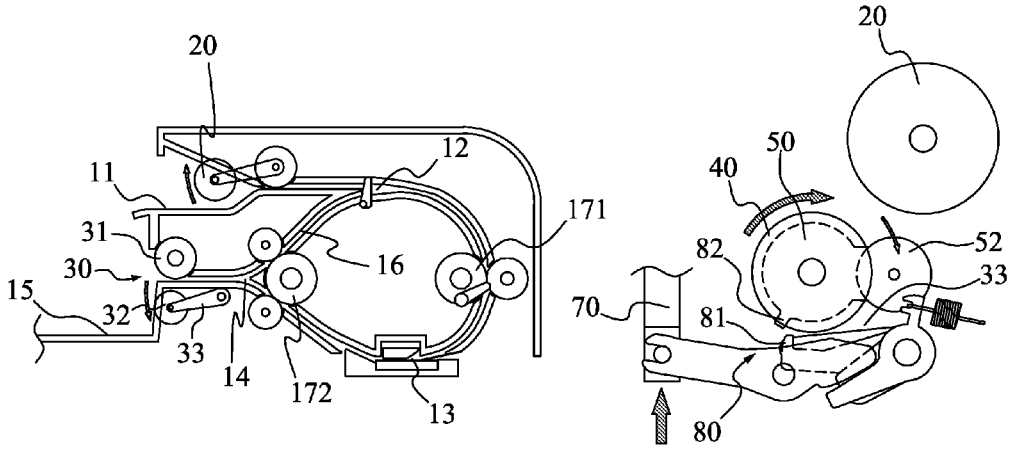

Referring to FIG. 8B, when the document is picked into the input path 12 and contacted with the scan roller 171, the actuator 70 drives the braking device 80 to release the transmitting gear swing arm 50. So the transmitting gear swing arm 50 will swing to the second position when the first driving gear 40 rotates clockwise so as to separate the first driving gear 40 from the pickup device 20 to stop picking documents. The document picked into the input path 12 will be transmitted through the paper transmitting path 10 by the scan roller 171.

Figure 9A:
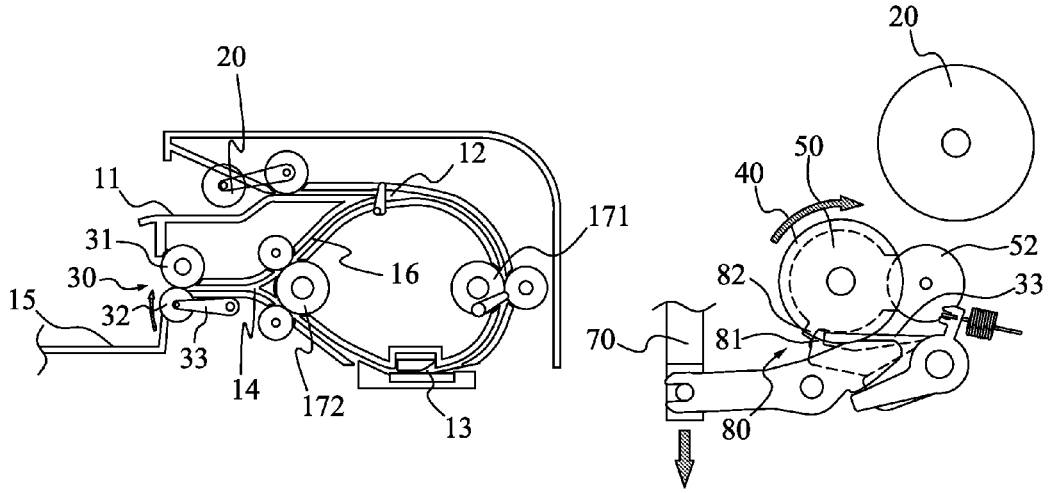

Referring to FIG. 9A, when the transmitting gear swing arm 50 swings to the second position, the actuator 70 stops acting and the braking device 80 locks the transmitting gear swing arm 50 at the second position.

Figure 9B:
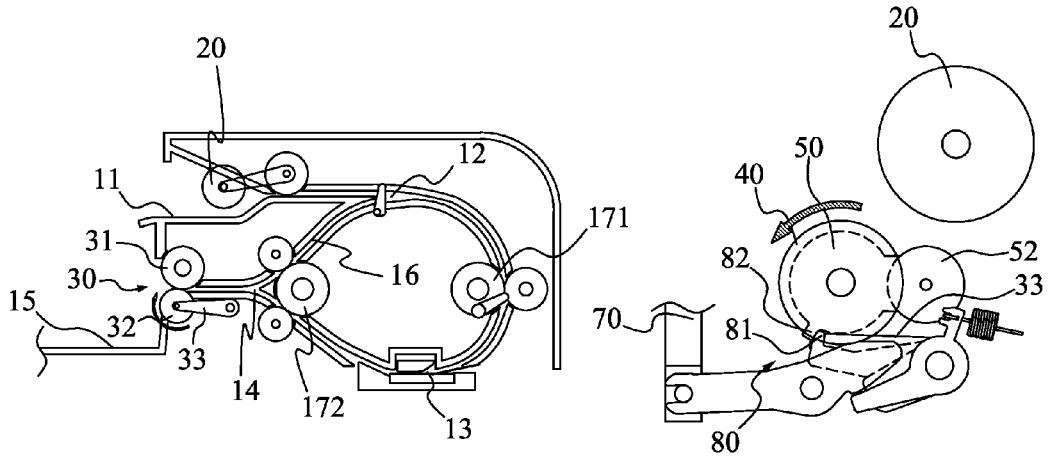

Referring to FIG. 9B, when the first side of the document is scanned and the following end of the document exits the scanning area 13 and the output path 14, the driving motor 41 will reverse. Since the transmitting gear swing arm 50 is at the second position idling the first transmitting gear 52, the pickup device 20 will keep still. Meanwhile, the output device 30 will transmit the document back into the reverse path 16 with the driving torque of the driving motor 41.

Figure 10A:
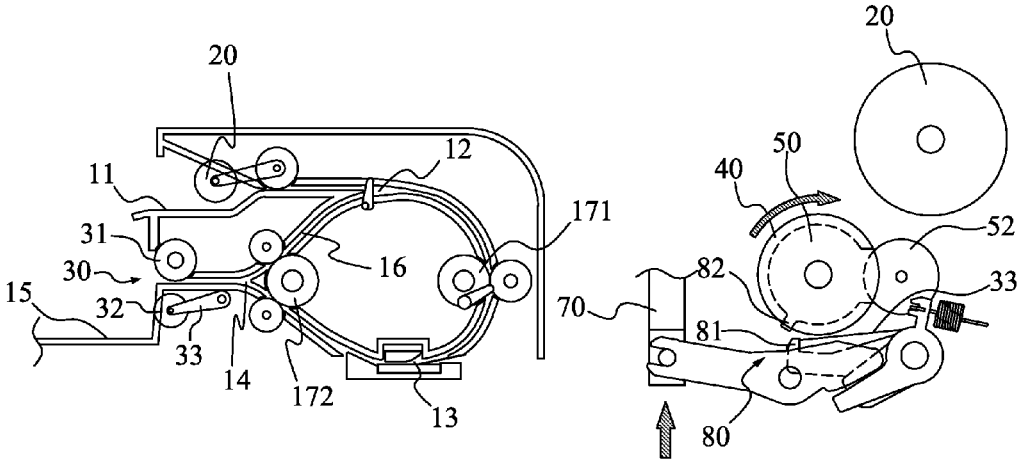

Referring to FIG. 10A, after the document enters the reverse path 16 for tuning over, the actuator 70 acts again to swing the pressure roller swing arm 33 downward and separate the pressure rollers 32 from the document (and also release the transmitting gear swing arm 50), and the driving motor 41 rotates clockwise again. So the document will pass through the scanning area 13 for the second time by the driving of the transmitting roller 171. Although the transmitting gear swing arm 50 is released by now, the driving motor 41 is rotating clockwise so the transmitting gear swing arm 50 shall keep at the second position.

Figure 10B:
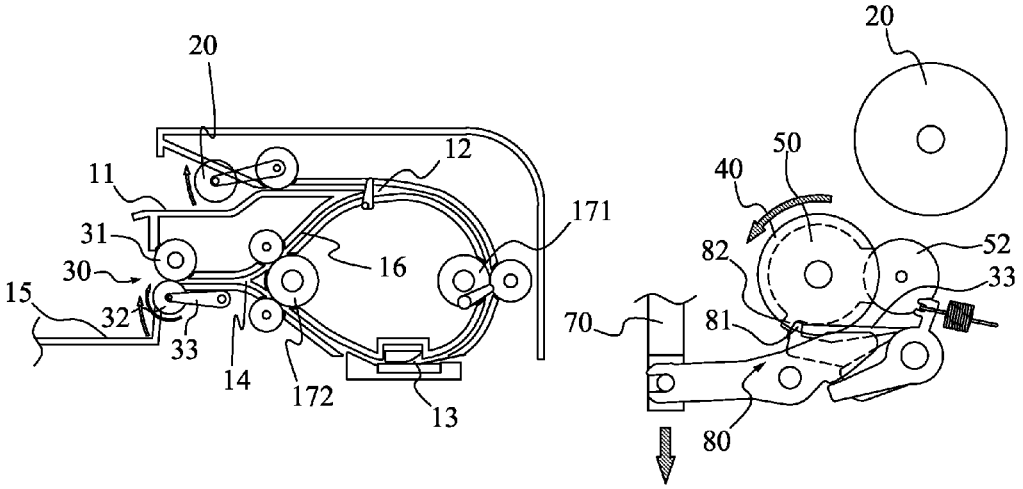

Referring to FIG. 10B, after both sides of the document are scanned and the following end of the document exits the scanning area 13 and the output path 14, the document will be turned-over again to turn the first side up. The actuator 70 stops acting to swing the pressure roller swing arm 33 upward and contact the pressure rollers 32 with the document (and meanwhile lock the transmitting gear swing arm 50), and the driving motor 41 rotates anticlockwise. So the output device 30 will transmit the document back into the reverse path 16 with the driving torque of the driving motor 41 rotating anticlockwise.

Figure 11A:
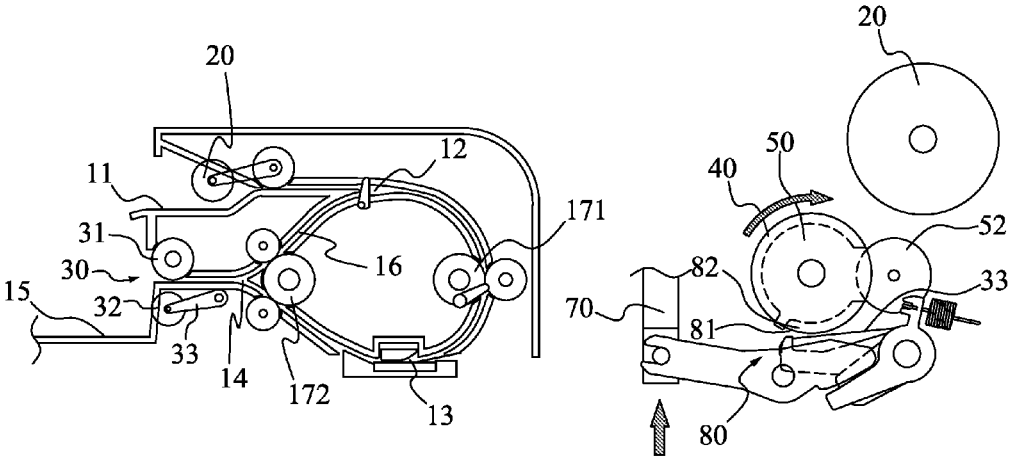

Referring to FIG. 11A, after the document passes through the reverse path 16 and is tuned over, the actuator 70 acts again to swing the pressure roller swing arm 33 downward and separate the pressure rollers 32 from the document (and thus release the transmitting gear swing arm 50), meanwhile the driving motor 41 will rotate clockwise. Then the document will pass through the scanning area 13 again with the driving of the scan roller 171, and enter the output path 14. Although the transmitting gear swing arm 50 is released now, the driving motor 41 is rotating clockwise, so the transmitting gear swing arm 50 will keep at the second position.

When the document is turned to make its first-side up again, the process of rejecting the scanned document is described as follows.

Figure 11B:
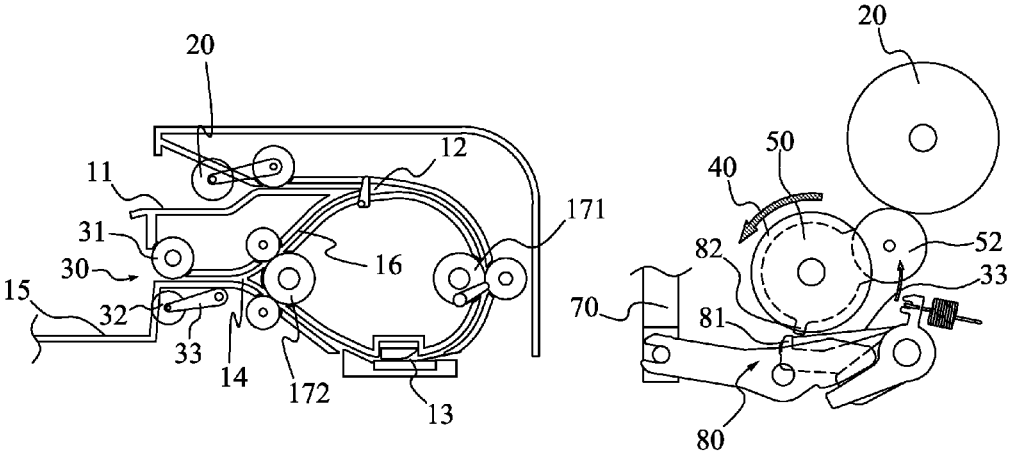

Referring to FIG. 11B, when finish scanning the document, the actuator 70 is acting, so the pressure roller 32 is separated from the document (and the transmitting gear swing arm 50 is released). Then the driving motor 41 will rotate anticlockwise to drive the transmitting gear swing arm 50 to swing to the first position meshing the first transmitting gear 52 with the pickup device 20. The transmitting roller 172 driven by the one-way gear set 60 will keep transmitting the document to the output path 14.

Figure 12A:
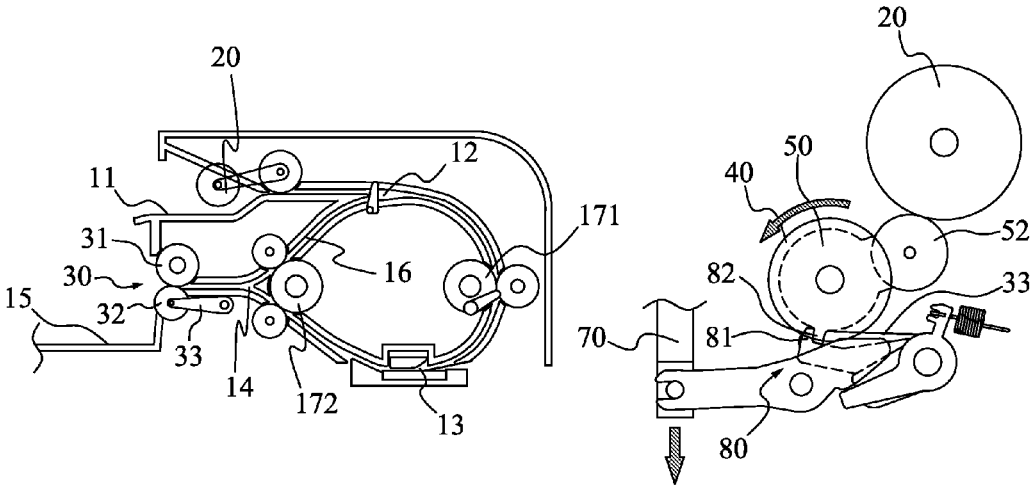
Figure 12B:
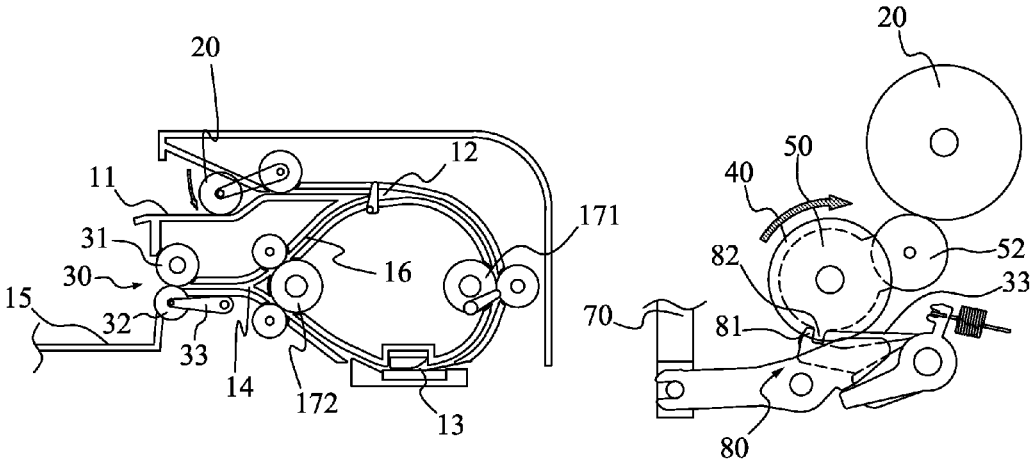

Referring to FIG. 12A, after the document enters the output path 14, the actuator 70 stops to swing the pressure roller swing arm 33 to the first position contacting the pressure roller 32 with the document (and also lock the transmitting gear swing arm 50). Referring to FIG. 12B now, the driving motor 41 rotates clockwise to transmit the scanned document through the output path 14, and the transmitting gear swing arm 50 is now at the first position meshing the first transmitting gear 52 with the pickup device 20, so the pickup device 20 will start to pick documents with the driving of the first driving gear 52.

In summary, the automatic document feeder is characterized in that the braking device 80 is disposed on the output device 30 and is driven and controlled by the output device 30 to determine whether and when the driving torque of the driving motor 41 is transmitted to the pickup device 20, so that effectively reduces the size and the production cost of the automatic document feeder.

What is claimed is:

1. An automatic document feeder, comprising:

a paper transmitting path including an input tray, an input path, a scanning area, an output path and an output tray in sequence from an upstream to a downstream along a document transmission direction of the automatic document feeder, wherein the upstream is designated at a document entrance and the downstream is designated at a document exit;

a driving motor for providing driving torque in different directions;

at least one scan roller and one transmitting roller disposed among the paper transmitting path;

a pickup device disposed at the upstream of the paper transmitting path to pick documents up under the control of the driving torque;

an output device including movable pressure rollers and acting rollers which are disposed at the downstream of the paper transmitting path to transmit the documents forward or backward under the control of the driving torque;

a first driving gear driven by the driving motor and disposed between the pickup device and the output device;

a transmitting gear swing arm axially hinged with the first driving gear and equipped with a transmitting gear set, the transmitting gear swing arm being swingable according to the driving torque in the different directions between a first position meshing the transmitting gear set with the pickup device and a second position idling the transmitting gear set;

an actuator connected with the output device for controlling the movement of the pressure rollers; and a braking device disposed on the output device which locks the transmitting gear swing arm according to the position of the output device, wherein the transmitting gear set includes a first transmitting gear and a first torque limiter, the first transmitting gear is hinged on the transmitting gear swing arm by means of the first torque limiter and meshed with the first driving gear.

2. The automatic document feeder as claimed in claim 1, wherein the pressure rollers of the output device are disposed opposite to the acting rollers, and a pressure roller swing arm is driven by the actuator for controlling the pressure rollers to contact with or separate from the acting rollers.

3. The automatic document feeder as claimed in claim 2, wherein the braking device includes a first latch disposed on the pressure roller swing arm and a second latch disposed on the transmitting gear swing arm, when the pressure roller swing arm rises, the first latch meshes with the second latch to lock the transmitting gear swing arm.

4. The automatic document feeder as claimed in claim 1, wherein the automatic document feeder further includes a one-way gear set disposed between the scan roller and the transmitting roller to apply the driving torque in a constant direction to the transmitting roller regardless of the directions of the driving torque provided by the driving motor.

5. The automatic document feeder as claimed in claim 4, wherein the one-way gear set connects with the scan roller and the transmitting roller, the one-way gear set is driven by the driving motor via the scan roller and then applies the driving torque to the transmitting roller, the one-way gear set includes a second driving gear, a one-way gear swing arm axially hinged with the second driving gear, an output gear meshed with the transmitting roller, a reverse gear meshed with the output gear and second and third transmitting gears hinged on the one-way gear swing arm, the one-way gear swing arm has two free ends and the second and third transmitting gears are hinged on the free ends respectively, the one-way gear swing arm is swingable according to the rotating direction of the second driving gear between a third position meshing the second transmitting gear with the output gear and a fourth position meshing the second transmitting gear with the reverse gear for applying the driving torque in a constant direction to the transmitting roller regardless of the directions of the driving torque provided by the driving motor.

6. The automatic document feeder as claimed in claim 1, wherein the actuator is a solenoid.

* * * * *